US006416420B1

(12) United States Patent
Stark

(10) Patent No.: US 6,416,420 B1
(45) Date of Patent: Jul. 9, 2002

(54) GOLF PUTTING PRACTICE

(76) Inventor: Jerome F. Stark, 1315 W. 20th St., Hastings, MN (US) 55033

( * ) Notice: Subject to any disclaimer, the term of this patent is extended or adjusted under 35 U.S.C. 154(b) by 24 days.

(21) Appl. No.: 09/678,455

(22) Filed: Oct. 3, 2000

(51) Int. Cl.[7] ..... A63B 69/36
(52) U.S. Cl. ..... 473/257; 473/266; 473/268
(58) Field of Search ..... 473/150, 151, 473/152, 153, 154, 155, 266, 267, 268, 257, 261, 393

(56) References Cited

U.S. PATENT DOCUMENTS

| | | | | |
|---|---|---|---|---|
| 1,655,751 | A | * | 1/1928 | Cody |
| 3,510,136 | A | | 5/1970 | Rospoli |
| 3,604,712 | A | * | 9/1971 | Prior et al. |
| 3,656,752 | A | | 4/1972 | Moriarty |
| 3,917,280 | A | * | 11/1975 | Grace et al. |
| 4,082,287 | A | | 4/1978 | Berkey |
| 4,765,624 | A | | 8/1988 | Sprague |
| 4,895,372 | A | * | 1/1990 | Muller |
| 4,927,153 | A | | 5/1990 | Schaefer |
| 5,007,646 | A | | 4/1991 | Baber et al. |
| 5,037,100 | A | * | 8/1991 | Montgomery, Sr. |
| 5,116,058 | A | * | 5/1992 | Theriault |
| 5,211,400 | A | | 5/1993 | Hall et al. |
| 5,273,284 | A | * | 12/1993 | Montgomery |
| 5,294,124 | A | | 3/1994 | Florian |
| 5,332,211 | A | | 7/1994 | Rife et al. |
| 5,413,348 | A | * | 5/1995 | Basso |
| 5,503,395 | A | | 4/1996 | Cook |
| 5,820,493 | A | * | 10/1998 | Price, Jr. |
| 6,019,685 | A | * | 2/2000 | Fonseca et al. |
| 6,146,285 | A | * | 11/2000 | Winslow |

FOREIGN PATENT DOCUMENTS

SE 9800024 A * 7/1999

* cited by examiner

*Primary Examiner*—Paul T. Sewell
*Assistant Examiner*—Nini Legesse
(74) *Attorney, Agent, or Firm*—R. C. Baker & Associates, Ltd.

(57) ABSTRACT

The golf putting practice device has a foundation frame, including a cantilevered support bracket. It has upper and lower optical position lines carried on transparent portions of plate members that are mounted on the cantilevered support bracket so that the plate members are parallel to each other and the optical position lines extend in the direction of a proper putting stroke. A ball-centering sight as well as a head mirror are also mounted on the support bracket. An angled mirror is also provided. A golfer using the device can observe problems with head movement during a putting stroke, as well as the exact posture of the ball, the putter head, and putter head movement during a putting stroke. The correct putting stroke is absolutely perfectly along the optical position lines.

8 Claims, 4 Drawing Sheets

GOLF PUTTING PRACTICE

BACKGROUND OF THE INVENTION

This invention relates to golf putting practice and more particularly to improved devices and methods for a golfer to use in practicing putting.

A multitude of devices have been proposed for golfers to use to improve their putting. But devices as heretofore known lack versatility for the golfer who seeks to improve not just one aspect but improvement for a whole stable of putting problems. For example, known devices seem to concentrate on assisting the golfer to attain a straight putting stroke, or proper alignment of one's head above the ball, or ball positioning, or putter positioning, etc. The precision with which each such objective can be achieved using heretofore known devices is an open question. Too frequently a compromise has been reached in arriving at the design of the heretofore known putting practice devices, with the result that ease of use dominates over the teaching and learning value of the devices.

In essence, a versatile, simplified and compact putting practice device that permits a golfer to address and study a whole stable of problems (such as the golfer's putting stroke and stance and head and body relationships) has been lacking, but is sorely needed and has been long desired.

SUMMARY OF THE INVENTION

The putting practice device of this invention has multiple elements all mountable on a simplified foundation frame. The foundation frame is compactly designed and critically has a base member and a cantilevered support bracket or head that projects upwardly and outwardly from the base member to an elevated location in front of the front edge of the base member.

An upper optical position line extends parallel to the width dimension of the base member and is carried on a transparent portion of a plate member mounted on the cantilevered support bracket at an upper location so that the upper optical position line is outward in front of the cantilevered support bracket.

A lower optical position line having a length greater than the width dimension of the base member lies in a relationship parallel to and spaced vertically below the upper optical position line. This lower optical position line is carried on a transparent portion of a plate member and the plate member is mounted on the cantilevered support bracket so that the lower optical position line is outward in front of the cantilevered support bracket.

Another preferred feature of the new putting practice device is the ball centering sight. This is mounted on the cantilevered support bracket at a location below the upper optical position line.

An especially desirable feature for the new practice device is that of a head mirror. This mirror facilitates the checking of the golfer's possible head movements while making a practice putting stroke. The head mirror is also mounted on the foundation frame. It is mounted in a manner permitting it to lie in a plane perpendicular to a vertical plane passing through both the upper and lower optical position lines. The mounting permits the head mirror to lie in essentially a horizontal orientation so as to make it possible for a golfer using the device to see the golfer's head and eyes in the mirror when the golfer views the upper and lower optical position lines as one line (i.e., as coinciding).

A further desirable feature for devices of the invention is that of an angled mirror mounted on the foundation frame so as to slope upwardly and rearwardly from the front edge of the base member of the foundation frame. This angle of slope is such that the golfer in a stance for putting practice using the device can see in the angled mirror both the golf ball position and the putter position in a putting practice stroke.

A special advantage offered by the preferred practice of the invention is that all elements fastened to the cantilevered support bracket are removably fastened thereto, and in fact the angled mirror on the base member is also preferably removable, so as to permit compact storage and easy transport of a practice device to different putting practice sites, whether on a green or a carpet. Removably mounted elements are one thing, but the ease and reliability of remounting the elements in properly oriented relationship to each other is an even more important benefit provided by the invention.

Still other benefits and advantages of this invention will be evident as this description proceeds.

DESCRIPTION OF PREFERRED EMBODIMENT(S)

Figure 1:
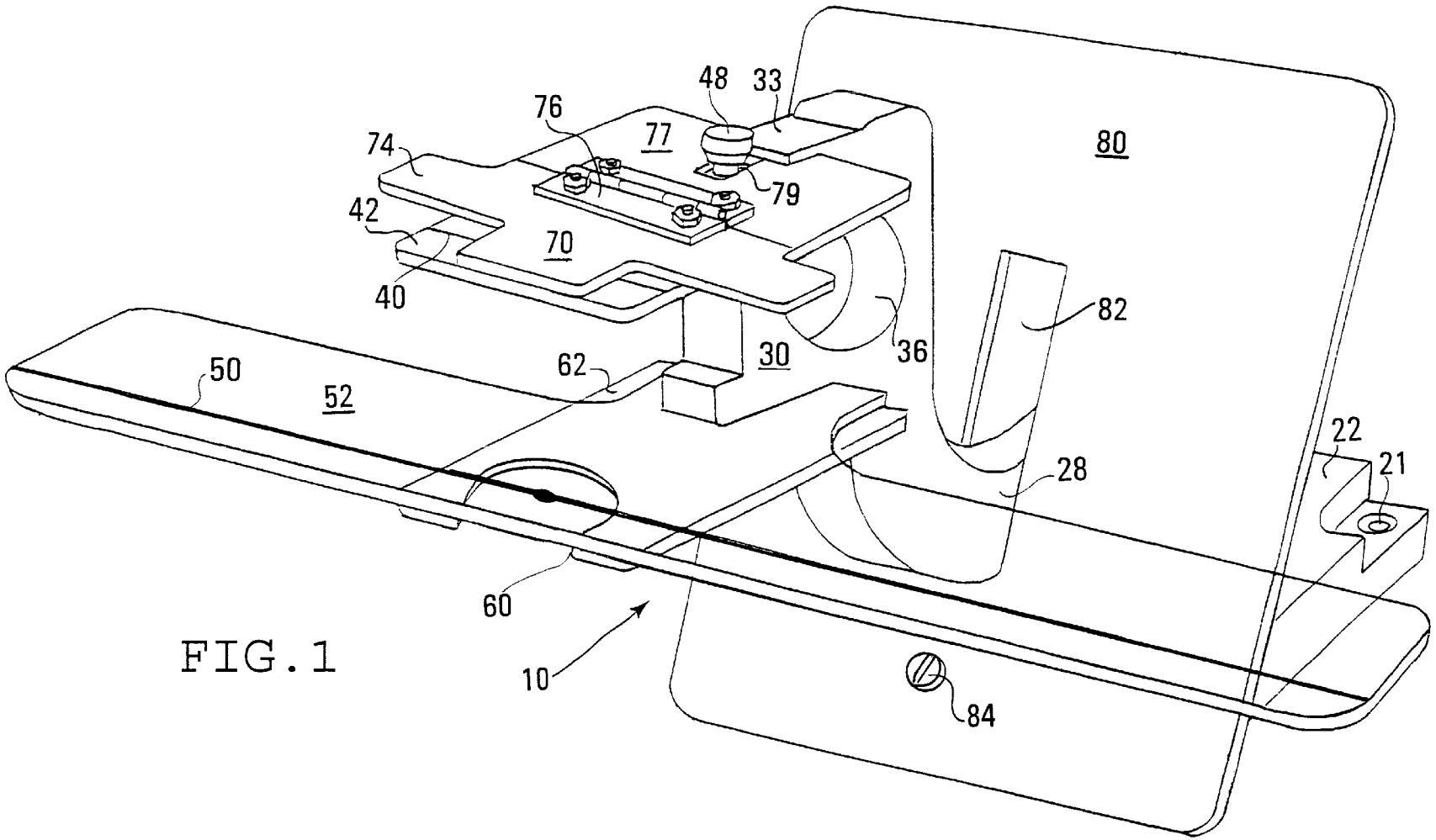
FIG. 1 is a schematic perspective view of the new putting practice device.
Figure 2:
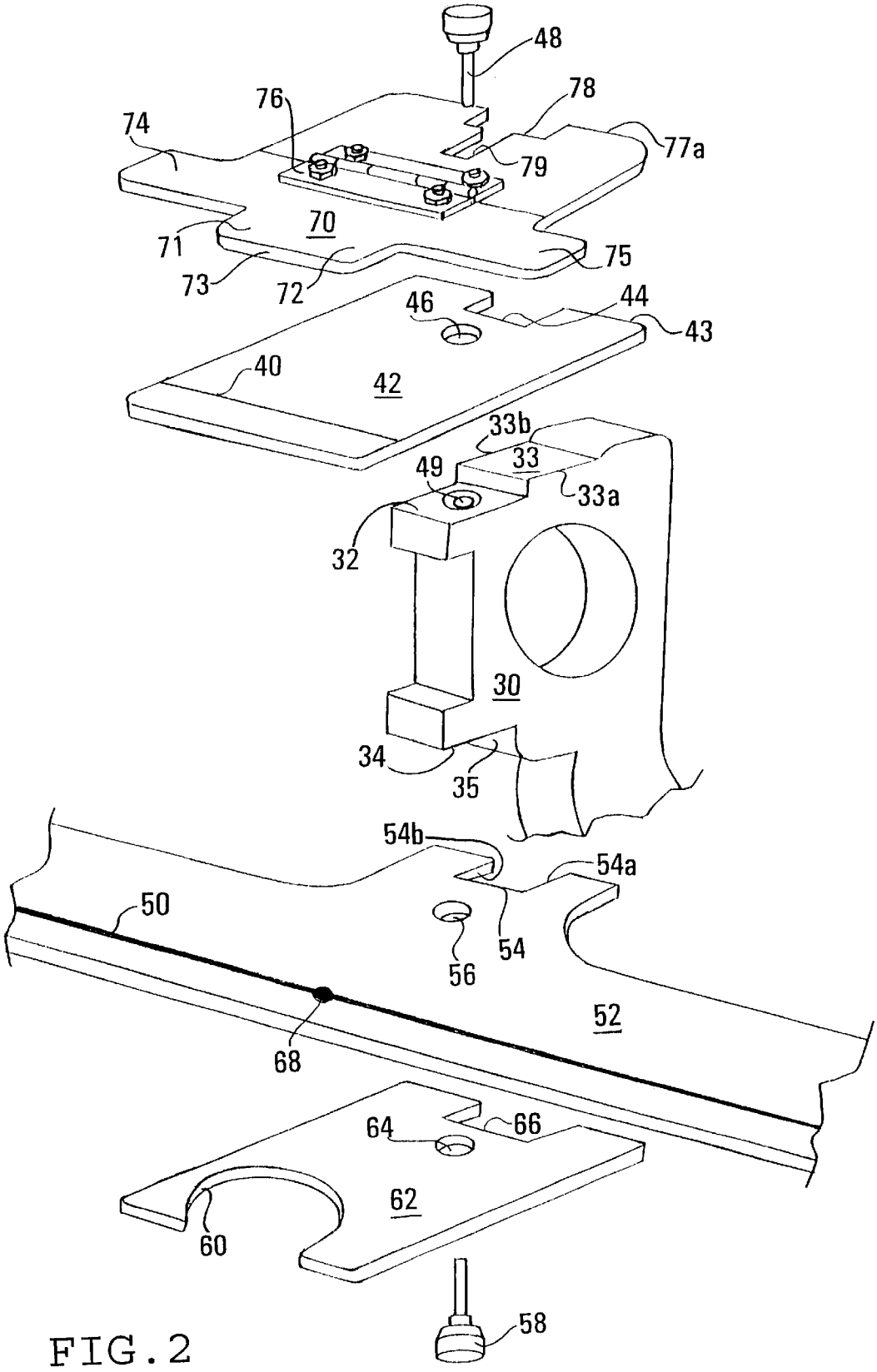
FIG. 2 is an exploded view of the elements of the device, with parts of the foundation frame located below the cantilevered support bracket broken away, and with end parts of the lower plate and lower optical position line also broken away.
Figure 3:
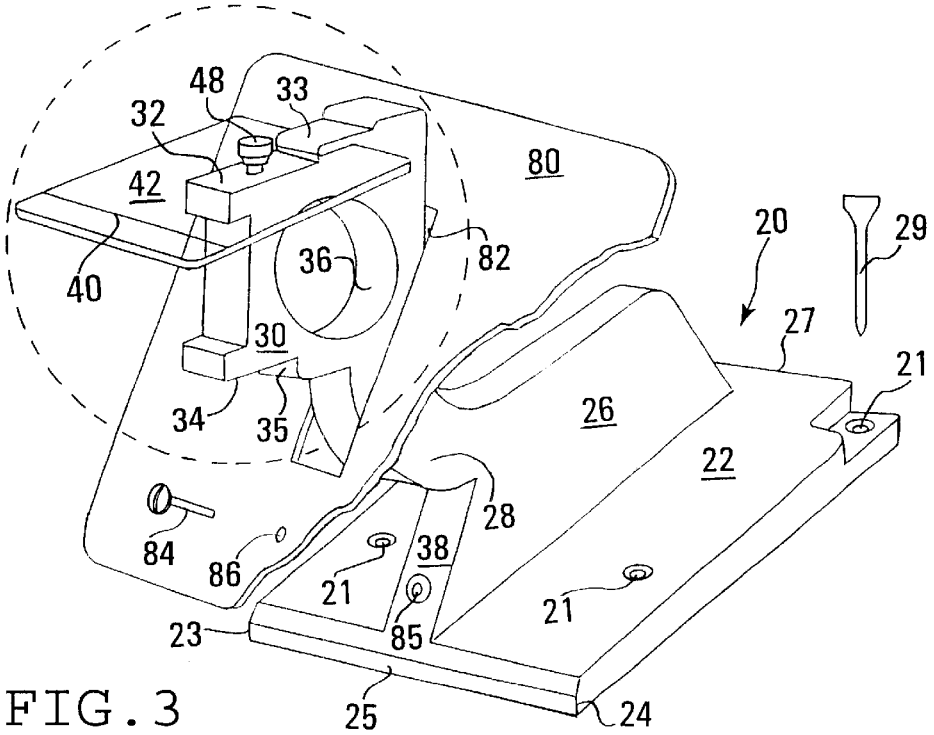
FIG. 3 is a schematic perspective view of the device with multiple parts removed and many broken away, and with the angled mirror shown in exploded or spaced relationship with respect to the base member of the foundation frame.

Referring now particularly to FIGS. 1, 2, and 3, special structural elements of the putting practice device will first be described.

The major elements forming the ideal practice putting device 10 comprise a foundation frame 20, an upper optical position line 40 on plate 42, a lower optical position line 50 on plate 52, a ball-centering sight 60, a head mirror 70, an angled mirror 80.

The foundation frame itself is believed to be unique in the annals of golf putting practice devices. That frame has a base member 22, an upstanding neck 28, and the cantilevered support bracket 30. The base member 22 is adapted to rest upon a putting surface (whether a green or a carpet). When rested upon a putting green, anchoring holes 21 for receiving golf tees 29 pressed therethrough into the green are useful. The bottom or underside of the base member 22 should lie in a flat plane, but that bottom may have recesses in it which may be used for reduction of material and thus reduction of weight, or for insertion of weights so as to avoid the need for any anchoring devices such as tees through anchoring holes 21.

Further, the bottom of the base 22 has a width dimension (that is, a dimension between its lateral sides 23 and 24). It also has a depth or front to back (or rear) dimension between the front edge 25 and the back edge 27. The front-to-back dimension between front edge 25 and rear edge or back edge 27 generally is greater than the width dimension between lateral edges 23 and 24, for the reason that a base of such a size can easily be weighted so as to avoid the need for anchoring devices such as golf tees. The size and weight are helpful to counterbalance the weight of the cantilevered portions of the device. In this respect, upstanding body 26 contributes to the weight counterbalance for the frame and the entire device. The neck 28 extends upwardly in a forward or front direction and supports the cantilevered support bracket 30.

To be noted is that the body 26, neck 28, and support bracket 30 all are relatively thin in lateral directions; and for observation of this, please note the lateral edges 33*a* and 33*b* of the cantilevered support bracket 30. The cantilevered support bracket 30 (which also might be called a head) has a number of special features contributing to its function as the mounting base for a multitude of the elements of the practice putting device. It has a top or upper planar support 32 that in essence is horizontal and parallel to the plane of the bottom surface of the base member 22. The upper planar support surface 32, at its rearward edge, has a centering block referred to as the upper centering block 33, with a straight abutment shoulder at the front edge of that centering block 33. A hole 49 extends downward from the plane of the planar support 32 and is threaded for receiving a fastening screw 48.

A bottom or lower planar support 34 is also on the support bracket 30, and this bottom or lower planar support 34 likewise has a horizontal surface parallel to the plane of the bottom of the base member 22. (The lower planar support surface 34 is on an underside part of the bracket 30.) As in the case of the upper planar support 32, the lower planar support 34 has a bottom or lower centering block 35 at the rear of the lower planar support 34. Also, through the lower planar support is a hole comparable to the hole 49 in the upper planar support, and that hole (not shown) is for receiving a fastening screw or bolt 58.

An opening or relatively large hole 36 extends through the cantilevered support bracket 30 and functions to reduce the weight of the material forming the cantilevered support bracket or head. It also has the interesting function of receiving a finger of a person, and thus hole 36 functions as a handle or gripping point for lifting the entire practice device and moving it to different locations.

To be noted is that the frame 20 also has a sloped part 38. The slope 38 is at the front of the body 26 extends rearwardly as an angled slope from the front edge 25 of the frame.

Ideally the frame should for the most part be formed of relatively lightweight material, and even the base need not be formed to be extremely heavy. Unnecessary weight is not desired. Just sufficient weight for a reasonable degree of counterbalance function is desired. The frame may be molded in plastic or cut from plastic sheets and glued together. Suitable plastics for the frame include the acrylic plastics, polycarbonates, polyurethanes, or any of a variety of others that are formable into a relatively rigid shape not suffering the defect of easy deformability or bendability or the like. Stiff rigid frames are preferred in order to achieve and preserve the optical relationships for the invention.

The width of the support bracket 30 between its lateral sides 33*a* and 33*b* may vary, but preferably, for the purpose of having the proper width for the planar supports 32 and 34, the width should be at least about 1 centimeter or so-although the greater preference lies for planar supports having width of at least about 1.5 centimeters. The width for those supports need not exceed 2 centimeters.

The depth distance for the planar supports, from the front edge to the rear edge or back edge abutting the front shoulder portion of the centering blocks, should be greater than the width dimension of the planar supports—although it may be equal to the width dimension of the planar supports. It ideally should exceed 1.5 centimeters, and even exceed 2 centimeters in depth, but need not be greater in depth than about 2.5 or 3 centimeters. Planar supports 32 and 34 of the preferred size as discussed are important for maintaining the mounting of plate structures of the new device in an orientation for optical precision.

The base member 22 for the foundation frame may vary in size, but a very practical and preferred base member for the foundation frame is approximately 10 centimeters in width and 15 centimeters in depth. Realistic base members may vary in their width and depth dimensions as much as plus or minus 50 percent of those preferred approximate measurements.

The cantilevered support bracket 30 projects outwardly from the front edge of the base member but need not project any great distance. A 3 or 4 centimeter projection can be quite adequate, and even a projection as little as 1 centimeter can be useful. A projection is needed to that the rearward mounting extensions or parts of the plate members are of reduced length. Their length should not be so great that the optical relationships for the position lines to be discussed are easily thrown out of kilter during mounting steps.

A critical feature of the new device is the upper optical position line 40 on the upper optical position plate 42. The upper optical position line 40 extends in a direction parallel to the width dimension of base member 22. It is on the plate at a transparent portion of the plate 42. Generally the plate 42 will be transparent throughout. A recess 44 extends within the plate from the extension forming the rear edge 43 of the plate. Recess 44 in effect forms lateral wing extensions at the rear 43 for the plate 42, and the lateral wings embrace the top centering block 33 at its lateral sides 33*a* and 33*b*. Extending vertically through the plate 42 is a hole 46 through which a fastening member such as screw or bolt 48 is passed on its way into a threaded hole 49 in the support bracket. Plate 42 is flat and its bottom surface is flat and rests on the upper flat planar support 32 of bracket 30 when it is properly mounted.

The length dimension of the upper optical position line 40 preferably should be at least about 4 or 5 centimeters and may in fact be much greater, but a length dimension for the upper optical position line need not exceed about 7 or 8 centimeters. Excessive length for the upper optical position line on an extremely wide plate is unnecessary and only adds to bulk without any significant functional benefit. The plate thickness may only slightly exceed 1 millimeter. The main point is that the plate thickness should be great enough so that the plate itself remains as a rigid plate as distinct from a flimsy, easily bent or distorted plate.

The lower optical position line 50 ideally has a length greater than the width dimension of the base member 22 and should be at least 20 centimeters in length up to as much as 40 or even 50 centimeters in length, although about 30 centimeters in length is probably the most practical length for dismantling and storage for transport of the device (in dismantled condition) to different putting practice sites.

The length of the lower optical position line is important to allow a golfer to check the putter path of a putting stroke, and also the path of the golf ball hit by the putter. Importantly, the lower optical position line 50 and the plate 52 on which it is carried must be at an elevation above the putting practice surface sufficient to not interfere with putting of the golf ball. Generally this means a clearance space between the practice surface and the lower optical position line 50 and plate 52 of at least about 6 centimeters. A clearance greater than 15 centimeters is unnecessary and detracts from compactness. A clearance of about 10 centimeters is ideal.

The lower optical position line 50 lies in a relationship parallel to and spaced vertically below the upper optical position line 40. The distance below the upper optical line may vary, but for practical purposes, it should be at least about 4 centimeters up to about 8 centimeters below the upper optical position line. A distance less than about 4 centimeters reduces the likelihood of a golfer achieving orientation of the upper and lower lines to coincide with each other in a truly vertical relationship.

But a distance greater than about 8 centimeters increases the size or bulk of the device too greatly to make it valuable as a practical putting practice tool. At about 5 centimeters between the upper and lower optical position lines, a vertically downward eye view for orienting the optical position lines so they appear as a single line causes an excellent positioning of the eyes of the golfer in a truly vertical position above the optical lines.

The lower line 50 is carried on a transport portion of a plate member 52, and indeed, the preferred plate member is such that it is transparent throughout. A recess 54 into the rear edge of the rear extension for the plate member 52 is such as to form lateral wings at the rear extension, and those lateral wings embrace snugly the lateral sides of the bottom or lower centering block 35. As with the embrace of the lateral wings of the upper position plate 42, the embracing by the lateral wings of the bottom or lower plate 54 on the centering block 35 function as a mounting aid to orient the plate in a manner such that the optical position line (in each instance) extends in a direction perpendicular to the cantilevered support bracket 30. The effect is that both optical position lines 40 and 50 are placed in a truly parallel orientation when the plate members carrying them are properly mounted on the support bracket.

Hole 56 in the lower optical position plate receives the threaded fastening element 58 on its way to a threaded hole into the support bracket 30 from the bottom or lower planar support 34 of that bracket.

A special ball centering sight should also be mounted on the cantilevered support bracket at a location spaced below the upper optical position line. Illustratively, the ball-centering sight may take the form of a ball-centering plate 62 having a ball-centering sight curvature 60 into the plate from the front edge of the plate. (The ball-centering curvature 60 may have a diameter of about 1⅝ inches or a diameter slightly smaller than the golf ball diameter of about 1¾ inches.) Plate 62 may be opaque. It is ideally equipped with a recess 66 into it from its rear edge, and the recess 66 forms lateral wings for embracing the centering block 35, much the same as the lateral wings of the optical position plates embrace a centering block along its lateral sides during the mounting step. Again, the lateral wings on each side of the recess 66 abut the lateral sides of the centering block 35 and cause the plate 62 to extend perpendicularly outwardly from the support bracket 30. Hole 64 is for the fastener 58 to pass through on its way to a foundation anchoring in the support bracket 30. A noteworthy alternative to a ball-centering sight in plate form is that of placing a small circle or enlarged dot on the plate carrying the lower optical position line at a centered location on the lower line 50 perpendicularly outward from the support bracket 30. The more ideal ball-centering sights are, of course, those having a curvature 60, whether in a separate plate member or inked upon or otherwise etched or printed upon the lower optical position plate 52. Ball centering is an important step in the process of putting practice using the device, but the benefits of the new putting practice device of the invention go well beyond ball centering. Significantly, the ball centering sight is below the upper optical position line and does not obstruct view of the lower optical position line. Thus, the eyes of a golfer looking down upon the upper optical position line and orienting that line to coincide with the lower optical position line will see the centered golf ball on the putting practice surface as being substantially bisected by the coinciding upper and lower optical position lines. Put another way, when the golfer orients the upper and lower optical position lines to coincide, the golfer will see the golf ball on the putting surface as being substantially bisected by those lines when the golf ball is centered in its relationship to the ball centering sight.

Figure 4:
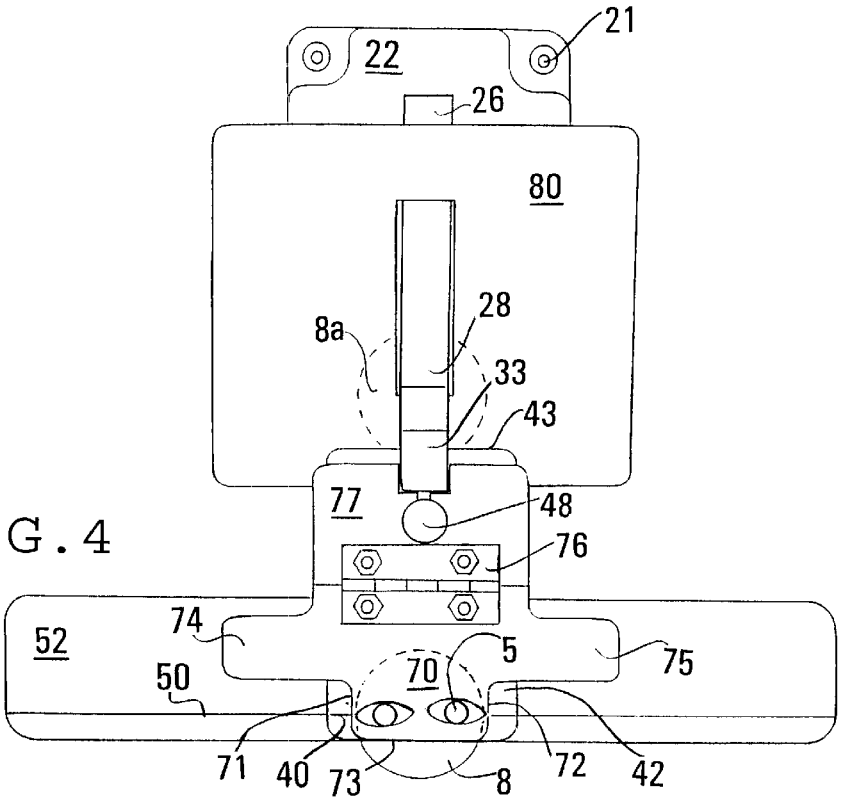
FIG. 4 is a top plane view of the device of FIG. 1 illustrating the reflection of a golfer's eyes as a golfer in a putting stance looks directly downward over a golf ball (a putter head is omitted from the drawing solely to avoid clutter)

A rather important feature of the invention is that of an entirely new approach to mirror checking of a golfer's head movement. The invention provides a new type of head mirror 70. This mirror is such that it actually blocks out a portion of the optical position lines when it is placed in a horizontal orientation or parallel orientation with the plate members carrying the optical position lines. The mirror 70 has a front projection terminating at a front edge 73. Edge 73 extends over a portion of the optical position line 40 and therefore also over a portion of the optical position line 50 when the two lines 40 and 50 are view-oriented to coincide. The projection forming the front edge 73 of the mirror is limited in width, however. Specifically, the lateral sides 71 and 72 of the projecting mirror are such that the projection 73 does not block out the entirety of the upper optical position line 40 (and thus does not block out the entirety of the lower line 50). Ends of the line 40 are viewable by a golfer when the mirror 70 is horizontal in a position of readiness to reflect errors of head movement by the golfer. As illustrated in FIG. 4, the golfer's eyes 5 are reflected in the head mirror when the golfer looks directly down on it with the upper and lower optical position lines merged or coinciding.

A feature of mirror 70 is that it is mounted on a hinge 76. The hinge is located between the forward mirror plate 70 and a rear mounting plate 77. The rear plate 77 suitably lies in the same plane as the forward plate 70 when the forward plate 70 is in a horizontal or downward position parallel to and over the plate 42 carrying the upper optical position line 40. The rear plate or portion 77 is equipped with a recess 78 extending inwardly from the rear edge of it, and that recess forms lateral wings that embrace and abut the upper centering block 33 at its lateral sides. In that manner, the composite assembly forming the head mirror arrangement is mounted on the cantilevered support bracket so as to project in a true perpendicular or straight manner forwardly of that support bracket. For convenience of removing and reinserting the mirror assembly on the cantilevered support bracket, the recess 78 is provided with an additional forwardly extending recess 79 in the nature of a slot that permits the fastening screw 48 to be merely loosened for adding the mirror assembly to (or removing it from) the support bracket 30. Lateral ears 74 and 75 on the mirror 70 permit a golfer to use a putter to lift the mirror out of position or to lower it into parallel position on the upper optical position plate 42.

A yet further unique feature of the invention is that of an angled mirror 80 having a slot 82 or other recess into it for pass-through of the cantilevered support bracket and neck 28 (or for pass-through of at least a portion of the neck 28 and most if not all of the cantilevered support bracket 30). This angled mirror is sloped from the front edge 25 of the base member 22 in an upward and rearward direction, most preferably at an angle of about 55 degrees up from horizontal base member 22. The range of variation of this angle is plus or minus 5 degrees (i.e., the angle should fall within about 50 to 60 degrees). The angled mirror is mounted on the foundation frame by a fastener 84 that extends through a hole 86 in mirror 80 on its way to the fastening hole 85 in the front sloped surface 38 of the body 26. Thus, the angled mirror is in effect mounted on the foundation so as to slope upwardly and rearwardly from the front edge of the base member of the foundation frame. The angle of slope should be such that a golfer in a stance for putting practice using the device can see in the angled or sloped mirror the golfer's ball position on the putting practice surface as well as the golfer's putter position relative to that putting practice surface.

Referring now to FIG. 4, when the hinged mirror 70 is flipped to a horizontal position (as illustrated in FIG. 4), the front projection 73 of the head mirror 70 blocks out the central portion of the upper optical position line 40. But side portions of that upper optical position line 40 are visible at the lateral sides 71 and 72 of the front projection 73 of the head mirror. Significantly, the upper optical position line therefore can be oriented to coincide with the lower optical position line 50 as a golfer looks straight down on head mirror 70. In fact, head mirror 70 reflects the golfer's eyes back to the golfer when the golfer has lined up the upper optical position line to coincide with the lower optical position line. Significantly, this also puts the golfer's head directly above the centered golf ball 8. No other practice putting device is known having anything so exacting as the relationships achieved by using the device of this invention.

Still further, in putting, the golfer draws his or her putter along a straight line as defined by the lower optical position line. As the golfer does this, it is possible for the golfer to notice head movements that the golfer may be making as the putting stroke is made; and these observations, easily made by viewing the reflection of the golfer's head in the mirror 70, are of critical significance for the golfer to improve putting. Holding a golfer's head against movement as the golfer makes a putting stroke is a fondly sought-after goal, and this device is excellent in showing errors of head movement to the putting golfer.

Still further, while the golfer is able to make observations using the mirror 70 as just described, the golfer additionally has the benefit of observing—in angled mirror 80—the exact posture of the golfer's ball 8*a* during putting as well as the exact posture of the golfer's putter. Specifically, the golfer can observe in mirror 80 whether the golfer's club face at its head is open or closed, the angle of it, and any heel or toe or sole problems (of the putter head in relation to the putting surface) as may be experienced by the golfer in making the putting stroke.

Golfers using putters with direction lines on the head of the putter may gain help by using the line or lines on the putter in combination with the lower optical position line as a tool or guide to achieve a straight putting stroke and follow-through.

Figure 5:
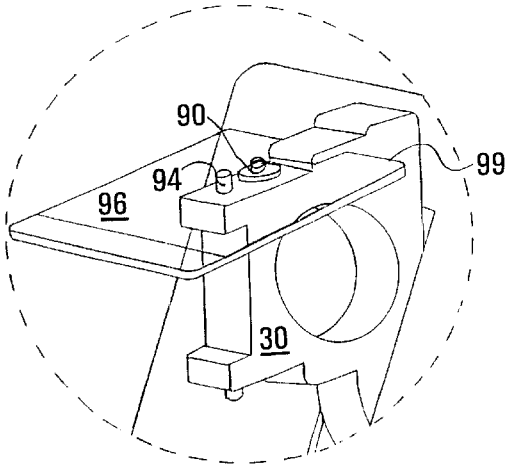
FIGS. 5 and 6 are schematic perspective views, with FIG. 6 being exploded, of an illustrative alternative mounting for plate members-specifically illustrated is the plate carrying the upper optical position line, with parts broken away.
Figure 6:
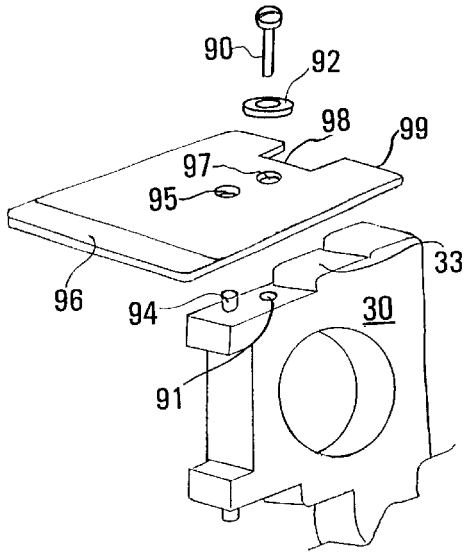

An optional type of mounting for the plate elements of the invention is illustrated in FIGS. 5 and 6, and may be looked upon as a three-point mounting consisting of a pin 94, a fastener screw or bolt 90, and an inward recess 98 from the rear edge 99. The recess 98 forms lateral wings as aforediscussed, and those wings embrace the centering block 33 at its lateral sides. The pin 94, the fastener 90, and the wings formed by the recess into the rear of the plate each contribute to an essentially perfect orientation of a plate as a perpendicular forward extension from the mounting bracket 30. It should be appreciated, however, that probably the most convenient mounting is that illustrated in FIG. 2 for the mirror 70. As illustrated in FIG. 2, the recess 78 from the rear edge of the plate has a slot 79 extending further inward (i.e., forward) to accommodate a bolt or screw without the need for removal of the bolt or screw from the support bracket 30 during mounting and demounting (i.e., disassembly).

Figure 7:
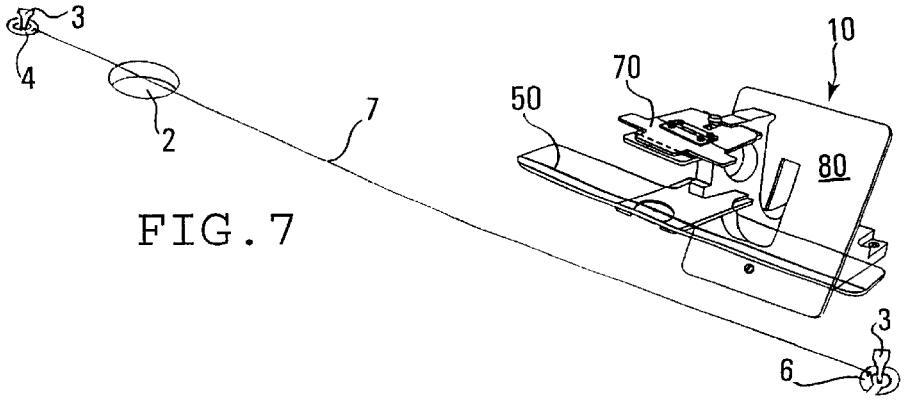
FIGS. 7 and 8 are schematic perspective illustrations of a technique for aligning a golf putting practice device of the invention with respect to a hole on a putting green.
Figure 8:
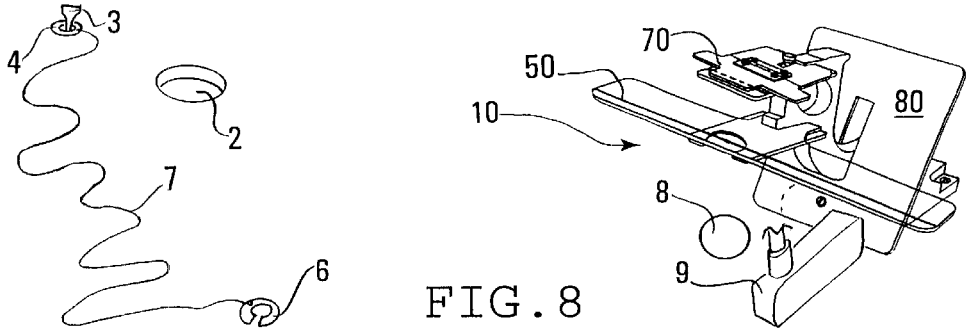

Referring now to FIGS. 7 and 8, a method for orienting the entire device 10 in perfect alignment for a putting stroke to a golf hole 2 will be described. To do this, it is convenient to stretch an alignment or guide line 7 (preferably one of elastomeric character) between two anchor points so that the line 7 bisects the hole 2. The alignment guide line 7 is fastened at one end to a washer or ring 4 and fastened at the other end to another washer or ring or to a C-shaped terminal. A golf tee 3 is used to anchor one end 4 at a location near the golf hole 2, and the other end 6 of line 7 is anchored by a tee 3 on the putting surface at a greater distance away from hole 2 (e.g., a distance chosen for practice putting). Realistically, either end of the line 7 may be first fastened at a location relatively distant from golf hole 2 and then the anchoring of the other end of line 7 at a location near the golf hole may be accomplished. In either event, the line 7 should bisect the golf hole 2, and preferably line 7 is stretchable and is stretched so as to form a relatively perfect straight line to the hole 2. Further, the line 7 should be stretched over a flat putting surface.

Then the putting device 10 of the invention is placed adjacent the line 7 so that the optical position line 50 (and also 40) of the putting device 10 are vertically aligned directly above the base guide line 7. Thereafter, as illustrated in FIG. 8, the base guide line 7 is removed from its anchor at the remote golf tee 5 and line 7 is pulled aside so as to not obstruct movement of a golf ball from the location of the putting device 10 to the golf hole 2. Next the golfer centers the golf ball 8 for putting practice and puts the head mirror 70 down to a horizontal position. The putter head 9 is then moved in the putting stroke hopefully along the line formed by the lower optical position line while the golfer's head is hopefully maintained in a stabilized condition directly above the golf ball and while the golfer observes the putting club head orientation in the angled mirror 80 of the golf putting practice device.

It should be recognized that the new putting device is primarily useful on flat or level putting surfaces, where a ball struck by a putter tends to roll in a straight line. A contoured putting surface presents an additional challenge for the golfer to estimate the change of direction—sometimes ever so slight—to be expected for a ball putted over the contour. The greater proficiency attained by the golfer in putting on flat surfaces, the more likely it will be for the golfer to find some degree of satisfaction for the golfer's estimates for ball movement when putted on a contoured surface.

Plastics of the polymeric type are the preferred material out of which to fabricate the new putting practice device, including the foundation frame and all plates and mirror. Plastics experts are well acquainted with a variety of plastics that satisfy the stiffness or rigidity requirements for the optical relationships of the invention. Of course, probably the most ideal plastic having the stiffness and rigidity needed is an acrylic polymer known commercially by the trademark Plexiglass, but many other plastics of satisfactory transparency and rigidity are equally suitable. Even the mirrors are preferably formed using plastic plates or panes as the base for the mirrors. Markings on the plates can be made in a variety of ways, such as by silk screening inks in the proper pattern, or by engraving, or laser printing, etc.

Those skilled in the art will readily recognize that this invention may be embodied in still other specific forms than illustrated without departing from the spirit or essential characteristics of it. The illustrated embodiments are therefore to be considered in all respects illustrative and not restrictive, the scope of the invention being indicated by the appended claims rather than the foregoing description, and all variations that come within the meaning and range of equivalency of the claims are therefore intended to be embraced thereby.

That which is claimed is:

1. A golf putting practice device comprising:

(i) a foundation frame having a base member that has lateral edges and a width dimension between said lateral edges and a bottom and a front edge between said lateral edges, said bottom of said base member being adapted to rest upon a putting practice surface, said foundation frame including a cantilevered support bracket that projects upwardly and outwardly from said base member to an elevated location in front of said front edge of said base member, (ii) an upper optical position line extending in a direction parallel to the width dimension of said base member, said upper optical position line being carried on a transparent portion of a plate member mounted on said cantilevered support bracket at an upper location so that said upper optical position line is outward in front of said cantilevered support bracket, (iii) a lower optical position line having a length greater than the width dimension of said base member and lying in a relationship parallel to and spaced vertically below said upper optical position line, said lower optical position line being carried on a transparent portion of a plate member mounted on said cantilevered support bracket so that said lower optical position line is outward in front of said cantilevered support bracket at an elevation sufficient to not interfere with putting a golf ball under said plate member carrying said lower optical position line, and (iv) a ball-centering sight mounted on said cantilevered support bracket at a location spaced below said upper optical position line such that the eyes of a golfer looking down upon said upper optical position line and orienting said upper optical position line to coincide with said lower optical position line will see that a golf ball on the putting practice surface is substantially bisected by said coinciding upper and lower optical position lines when said golf ball is centered in its relationship to said sight.

2. The device of claim 1 additionally comprising a head mirror for facilitating the checking of a golfer's possible head movement while making a practice putting stroke, said head mirror being mounted on said foundation frame in a manner permitting a horizontal orientation for said head mirror so as to make it possible for a golfer using said device to see said golfer's head in said mirror when said golfer has oriented said upper optical position line to coincide with said lower optical position line.

3. The device of claim 2 wherein said head mirror is equipped with an ear handle and is hinged to allow it to be flipped upwardly by its ear handle to a position out of the way of a view of said entire upper optical position line by a golfer whose head is directly above said line, and is capable of being flipped by its ear handle into a horizontal position for reflection of the golfer's eyes and head and partial blocking of said upper optical position line.

4. The device of claim 2 additionally comprising an angled mirror mounted on said foundation frame so as to slope upwardly and rearwardly from the front edge of said base member, said angle of slope being such that a golfer in a stance for putting practice using said device on a putting practice surface with a golf ball upon and a putter in putting relationship to the putting practice surface can see in said angled mirror said golfer's ball position on the putting practice surface as well as said golfer's putter position relative to said putting practice surface.

5. The device of claim 4 wherein said angled mirror is at an angle up from the horizontal base member of between about 50 and about 60 degrees.

6. The device of claim 1 additionally comprising an angled mirror mounted on said foundation frame so as to slope upwardly and rearwardly from the front edge of said base member, said angle of slope being such that a golfer in a stance for putting practice using said device on a putting practice surface with a golf ball upon and a putter in putting relationship to the putting practice surface can see in said angled mirror said golfer's ball position on the putting practice surface as well as said golfer's putter position relative to said putting practice surface.

7. The device of claim 1 wherein said cantilevered support bracket includes an upper planar support surface having a centering block at the rear edge of said upper planar support surface and wherein said plate member carrying said upper optical position line is removably mounted on said cantilevered support bracket so as to rest upon said upper planar support surface and embrace said centering block.

8. A method of preparing for golf putting practice comprising:

(a) selecting a golf putting practice surface having a substantially horizontal flat character along a path for a golf ball to a hole on that putting surface, (b) anchoring an alignment guide line at each end so that the guide line extends as a straight line along said substantially flat putting surface and bisects said putting hole, the anchor at one end of said line being relatively close to said putting hole and the anchor at the other end of said guide line being at least at a distance selected for a golf putting practice stroke, (c) positioning said golf putting practice device of claim 1 adjacent to said guide line at the selected putting practice distance in a manner such that the upper and lower optical position lines of said putting practice device are vertically above and parallel to said guide line, and, (d) removing said guide line from the area of said putting practice surface expected to be traversed by a golf ball to be putted at said putting practice device toward said golf putting hole.

* * * * *